US005943027A

United States Patent [19]

Thill et al.

[11] Patent Number: 5,943,027

[45] Date of Patent: Aug. 24, 1999

[54] TELESCOPIC ANTENNA ASSEMBLY

[75] Inventors: Kevin M. Thill, Scottsdale, Ariz.; William H. Darden, IV, Mundelein, Ill.

[73] Assignee: Motorola, Inc., Schaumburg, Ill.

[21] Appl. No.: 08/947,496

[22] Filed: Oct. 3, 1997

[51] Int. Cl.[6] ..... H01Q 1/36

[52] U.S. Cl. ..... 343/895; 343/702; 343/853

[58] Field of Search ..... 343/895, 702, 343/853

[56] References Cited

U.S. PATENT DOCUMENTS

| | | | |
|---|---|---|---|
| 3,824,600 | 7/1974 | Majkrzak et al. | 343/895 |
| 4,008,479 | 2/1977 | Smith | 343/895 |
| 4,121,218 | 10/1978 | Irwin et al. | 343/702 |
| 4,238,800 | 12/1980 | Newington | 343/715 |
| 4,868,576 | 9/1989 | Johnson, Jr. | 343/702 |
| 5,014,346 | 5/1991 | Phillips et al. | 455/89 |
| 5,134,422 | 7/1992 | Auriol | 343/895 |
| 5,198,831 | 3/1993 | Burrell et al. | 343/895 |
| 5,349,365 | 9/1994 | Ow et al. | 343/895 |
| 5,438,339 | 8/1995 | Itoh et al. | 343/702 |
| 5,450,093 | 9/1995 | Kim | 343/895 |
| 5,572,227 | 11/1996 | Pal et al. | 343/727 |
| 5,612,707 | 3/1997 | Vaughan et al. | 343/895 |
| 5,828,348 | 10/1998 | Tassoudji et al. | 343/895 |

OTHER PUBLICATIONS

Tay, Roger et al., "Wide Beamwidth Antenna System and Method for Making the Same", U.S.S.N. 08/567,698, Dec. 5, 1995, Atty. Docket No. CM01903J.

Filipovic, Daniel et al., "A Coupled–Segment Quadrifilar Helical Antenna", *IEEE MTT–Symposium on Technologies for Wireless Applications Digest* , Vancouver, BC, Feb. 23–26, 1997, pp. 43–46.

*Primary Examiner*—Don Wong
*Assistant Examiner*—James Clinger
*Attorney, Agent, or Firm*—Daniel W. Juffernbruch; Richard K. Clark; Lalita P. Williams

[57] ABSTRACT

A telescopic antenna assembly provides pairs of arms (210, 220, 230 and 240) on an elongated dielectric tube (260). A hot conductor (273) and a ground conductor (275) of a group of exciters couple energy between the arms and a feed line (250). The hot and ground conductors (273) and (275) slide within the tube (260) between extended and retracted positions while maintaining efficient electromagnetic coupling to the arms.

31 Claims, 4 Drawing Sheets

TELESCOPIC ANTENNA ASSEMBLY

BACKGROUND OF THE INVENTION

1. Technical Field of the Invention

The present invention relates to antennas and, more particularly, relates to telescopic antennas.

2. Description of the Related Art

A telescopic antenna assembly has previously been provided for a monopole antenna and for a dipole antenna where an elongated conductor forming a whip is capable of telescoping by sliding. The whip could be retracted into a stowed position and extended into an operating position. These whip antennas, however, although capable of being stowed compactly, are undesirable for receiving certain types of radio signals such as those of satellites.

BRIEF DESCRIPTION OF THE DRAWINGS

The present invention solves these and other problems as described herein in conjunction with the following drawings wherein.

DETAILED DESCRIPTION OF THE PREFERRED EMBODIMENTS

Figure 1:
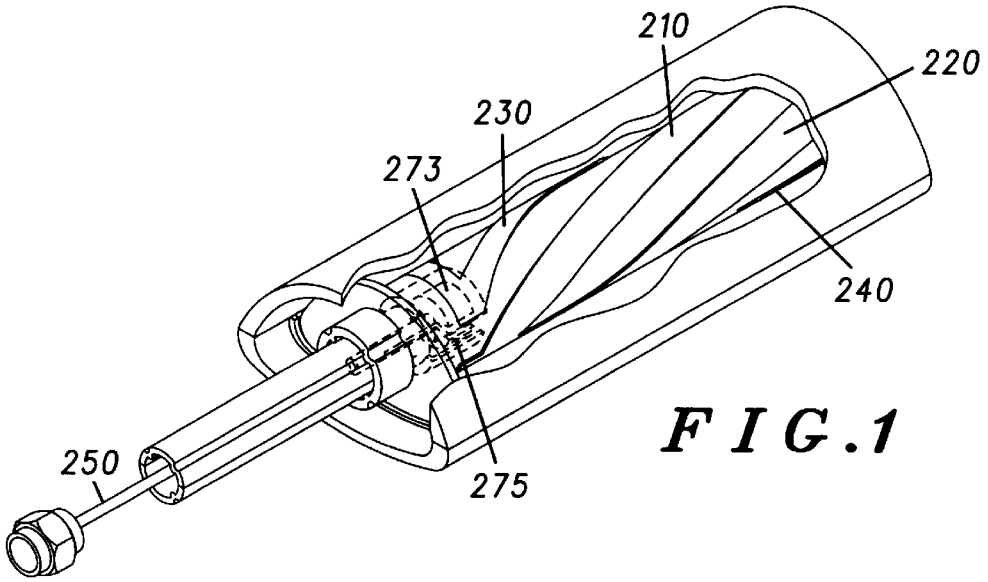
FIG. 1 illustrates a perspective view of an antenna assembly in an extended position.
Figure 2:
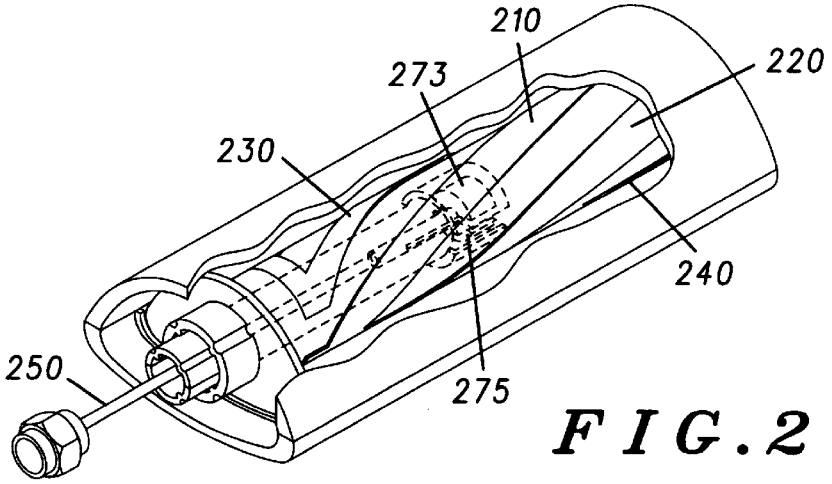
FIG. 2 illustrates a perspective view of an antenna assembly in a retracted position.

FIGS. 1 and 2 illustrate perspective views of a cutaway of the telescopic antenna assembly in respective extended and retracted positions according to a preferred embodiment. Two pairs of arms 210, 220, 230 and 240 are capable of transmitting and receiving electromagnetic radiation via a slidable coupling to a feed line 250. The slidable coupling provides a group of exciters 273 and 275 for coupling to the arms. The group of exciters preferably is a hot conductor 273 coupled to a center conductor of an unbalanced coaxial feed line 250, and a ground conductor 275 coupled to a ground of the unbalanced coaxial feed line 250. The hot and ground conductors 273 and 275 slide between extended and retracted positions to telescope the antenna. This moves the hot and ground conductors 273 and 275 relative to the arms 210, 220, 230 and 240 for electromagnetic coupling therebetween.

Figure 3:
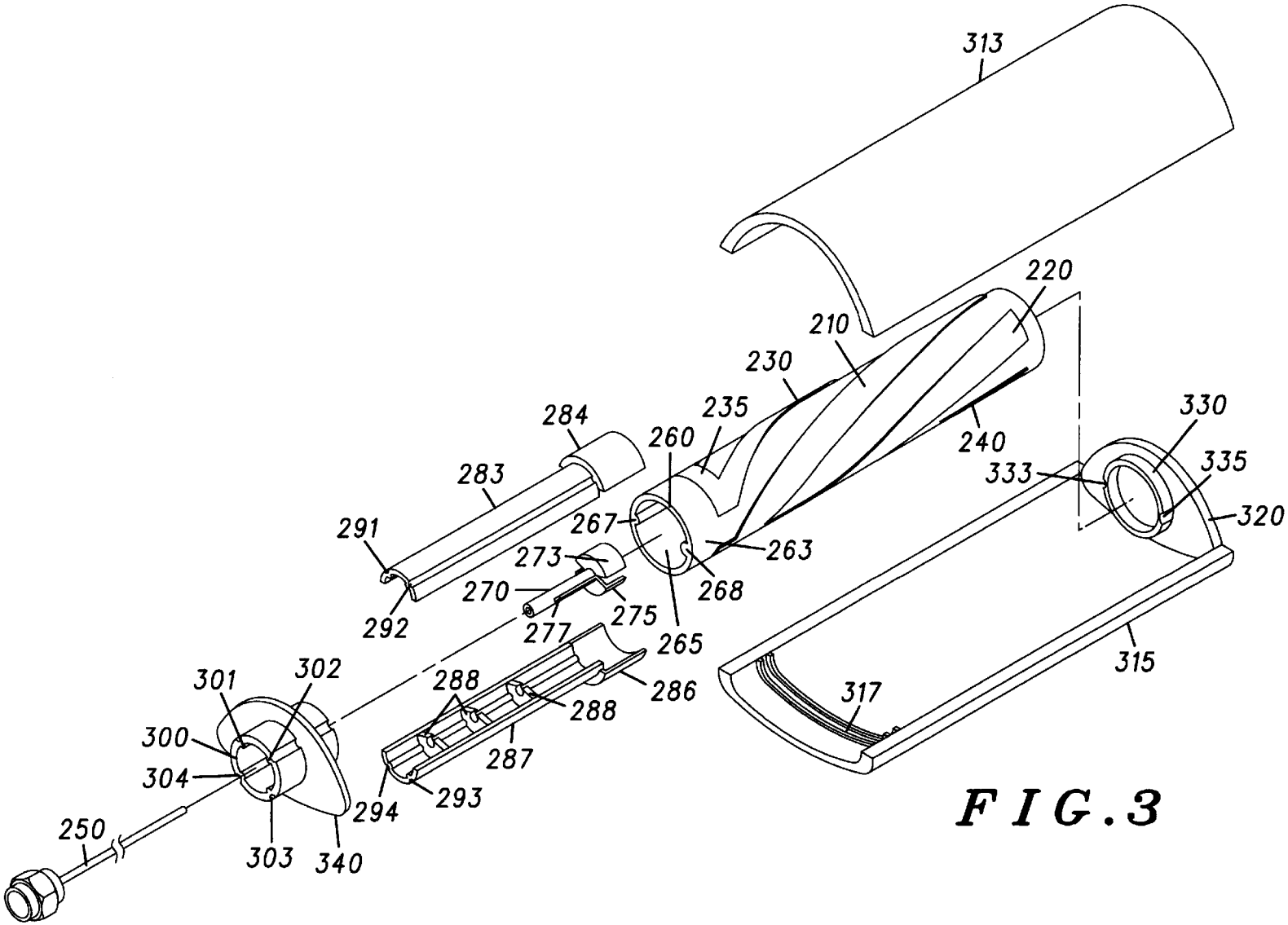
FIG. 3 illustrates an exploded perspective view of an antenna assembly.

FIG. 3 illustrates an exploded view of a telescopic antenna assembly according to a preferred embodiment. Two pairs of arms 210, 220, 230 and 240 are capable of transmitting and receiving electromagnetic radiation via a slidable group of exciters for coupling to a feed line 250. The arms extend from a lower end of the antenna element to an upper end of the antenna element. Two pairs of arms forms two crossed loops. In the preferred embodiment the loops are twisted crossed loops providing a quadrifilar helix antenna assembly capable of handling circularly polarized radio frequency energy. Circularly polarized radio frequency energy is being implemented in satellite communications systems.

The arms 210, 220, 230 and 240 are a conductive material preferably copper or gold metal that is plated, glued or etched onto an outside surface 263 of a an elongated dielectric tube 260. A hot conductor 273 of the group of exciters couples to a center conductor of an unbalanced coaxial feed line 250, and a ground conductor 275 of the group of exciters couples to a ground of the unbalanced coaxial feed line 250. The hot and ground conductors 273 and 275 slide relative to the arms 210, 220, 230 and 240 on a slidably-disposed bearing 283, 287, 300. The hot and ground conductors 273 and 275 of the group of exciters preferably are provided by hot and ground capacitive plates 273 and 275 to provide predominately capacitive coupling to the arms. Although a brush or an inductive coil can replace a capacitive plate, capacitive plates are preferred over brushes for mechanical reliability and preferred over inductive coils for improved packaging. The hot and ground capacitive plates 273 and 275 are fitted between respective halves 283 and 287 of an inner bearing for axially-sliding within the interior of the elongated dielectric tube 260. This sliding between extended and retracted positions moves the hot and ground capacitive plates 273 and 275 relative to the pairs of arms 210, 220, 230, 240 for electromagnetic coupling therebetween. A telescopic, multiple-arm antenna structure capable of receiving radio signals of the type in satellites is thus realizable in a compact structure.

The hot and ground capacitive plates 273 and 275 couple most efficiently to the arms 210, 220, 230 and 240 at certain positions along an electrical length of the arms. In the preferred embodiment of FIG. 3, the lower end of each pair of arms is shorted at, for example, item 235. One-quarter an electrical wavelength up each arm there will then be an open and a further quarter up an electrical length of the arms will be another short, electrically speaking. Current maximums and voltage minimums occur in the preferred embodiment at these electrically shorted locations. Thus, by physically shorting the arms at 235, an apparent electrical short will occur one-half a wavelength up a linear length of the arms, even though there is no actual electrical short. For optimum energy coupling between the arms and the capacitive plates, when sliding, the capacitive plate should stop near the shorts. The optimal extended and retracted positions for the capacitive plates are thus spaced approximately one-half a wavelength apart along an electrical length of the arms. Between these two optimal positions, however, energy coupling and radiation from the arms will occur, but not optimally. Because acceptable radio performance can occur at a position that is not exactly one-half a wavelength from the other, due to impedance, coupling and current distribution characteristics and the efficiency demands by a radio system in which the telescopic antenna is deployed, the positions are approximate positions. The electrical length of a wavelength is determined based on a frequency of interest for operation of the antenna, and, in the preferred embodiment, the frequency of interest is in the neighborhood of 1.621 Ghz. The electrical length of the arms of an antenna element is the same overall as an electrical length of an antenna in a structure such as the quadrifilar helix antenna element of the preferred embodiment.

Depending on the length of the arms, more than one one-half wavelength position can be realized. Nevertheless, in the preferred embodiment, the arms are three-quarter wavelengths long and thus, the optimum coupling positions are at the lower end short 235 and one-half wavelength up the arm, but one-quarter wavelength from the end of the arm. In the preferred embodiment of FIG. 3, the capacitive plates 273 and 275 do not move a full stroke from end to end of the arms, but, rather, move about two-thirds of the full stroke. Variations in the preferred embodiment can employ different stroke ratios. For example, to facilitate implementing a nearly full stroke antenna a different termination and current phasing approach could be utilized. An antenna having arm lengths of a full wavelength would have a nearly full stroke from end to end and also an optimal coupling position halfway between the ends at the one-half wavelength position.

The hot and ground capacitive plates 273 and 275 are formed in the preferred embodiment of a single conductive structure 270 having a split 277 therebetween along a partial axial length of the conductive structure 270. The conductive structure 270 is preferably a copper or gold plated plastic component. This split 277 provides for a split-sheath balun or balanced-unbalanced network. To form this split-sheath balun, an outer ground conductor of the unbalanced coaxial feed line 250 is connected to the conductive structure 270 just below the split 277. The center conductor of the unbalanced coaxial feed line 250 is insulated and led through the split 277 and electrically soldered or connected to the hot capacitive plate 273. The outer conductor of the coaxial feed line 250 and the conductive structure 270 could be integrally formed of the same material, and the split 277 formed in the outer conductor of a feed line in an alternate construction.

The halves 283 and 287 of the inner bearing have respective hot and ground dielectric plates 284 and 286 for protecting the capacitive plates 273 and 275 from sliding motion against an interior surface 265 of the elongated dielectric tube 260. The feed line 250 is held between the halves 283 and 287 by fingers 288. Hot and ground dielectric plates 284 and 286 could be eliminated in an alternate construction and the hot and ground plates 273 and 275 slide directly against an inside surface 265 of the elongated dielectric tube 260 or slide spaced a distance from the inside surface 265 with an air gap. In another alternative, the hot and ground capacitive plates could be metalized portions plated on an interior surface of the hot and ground dielectric plates 284 and 286, thereby eliminating the conductive structure 270.

Together the two halves 283 and 287 of the inner bearing have four straight grooves 291, 292, 293, 294 which respectively mate with four corresponding recesses 301, 302, 303, 304 on an inside surface of outer bearing 300. The grooves 291, 292, 293, 294 and recesses 301, 302, 303, 304 guide the hot and ground capacitive plates 273 and 275 when axially-slid within the elongated dielectric tube 260 during telescopic motion. The preferred embodiment uses a first approach where the capacitive plate 273 and 275 do not rotate when slid, because they are held by the straight grooves 291, 292, 293, 294 and straight recesses 301, 302, 303, 304. When the antenna is retracted to an optimum at approximately one-half wavelength position, the arms 210, 220, 230 and 240 need to be positioned relative to the capacitive plates 273 and 275 for coupling and, thus, the amount of twist of the arms about the dielectric tube 260 becomes critical. The configuration or twist of the arms is therefore important as will be discussed below with respect to FIGS. 4–9 according to the first, second and third alternative approaches.

In the first and third approaches, the capacitive plates slide axially but do not rotate because the grooves 291, 292, 293, 294 and recesses 301, 302, 303, 304 are straight. In the second approach of FIGS. 5 and 8, the capacitive plates 273 and 275 rotate when slid axially by the action of twisted grooves on an inner bearing, as will be discussed below with respect to the twisted groove bearing of FIG. 10.

The elongated dielectric tube 260 and arms 210, 220, 230 and 240 are preferably housed in a protective radome of halves 313 and 315. Radome half 313 is more arcuately curved than radome half 315. The bearing 300 is formed with a lower radome end 340 for assembly between halves 313 and 315 of the radome in slot 317. An upper radome end 320 contains annular flange 330 having a guide recess 333 and a somewhat larger guide recess 335 to respectively mate with key 267 and somewhat larger key 268 on an interior of the elongated dielectric tube 260. The keys 267 and 268 mate with the annular flange 330 to prevent the arms 210, 220, 230 and 240 from rotating within the radome structure and therefore provide a fixed relationship between the arms and the capacitive plates.

The somewhat larger recess 335 and key 268 is provided to avoid insertion error during assembly. The keys 267 and 268 are preferably provided along an entire length of the inside surface of the elongated dielectric tube 260 because it has been found that an extrusion technique is the most accurate of manufacture of the elongated dielectric tube 260. The accuracy of the location of the arms relative to the capacitive plates is of critical importance to achieve efficient operation of the antenna at more than one position. When the capacitive plates are slid relative to the arms, the distance therebetween is critical to maintain an accurate capacitance in each position to reduce electrical error and inefficiency. Although the axial sliding movement of the capacitive plate is the most apparent position change, radial separation, e.g., uniformity of dielectric, and position of the arms, e.g., amount of twist, can vary at different telescopic positions due to tolerance variations. It has been discovered that the radial separation and twist tolerances are critical and best handled by the constructions and examples illustrated herein.

Figure 4:
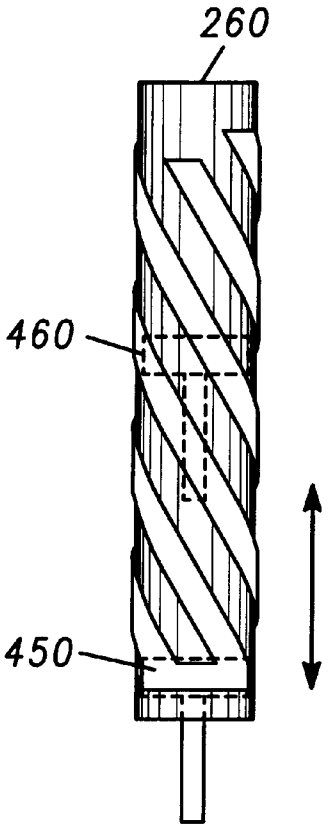
FIGS. 4 and 7, respectively, illustrate wound and unwound views of a sub-assembly of the antenna assembly according to a first arrangement.

FIG. 4 illustrates the elongated dielectric tube 260 with the capacitive plates in both an extended position 450 at a lower portion and a retracted position 460 at an upper portion according to a first approach where the arms are twisted at a constant angle and the capacitive plates are fixed and do not rotate when slid.

Figure 5:
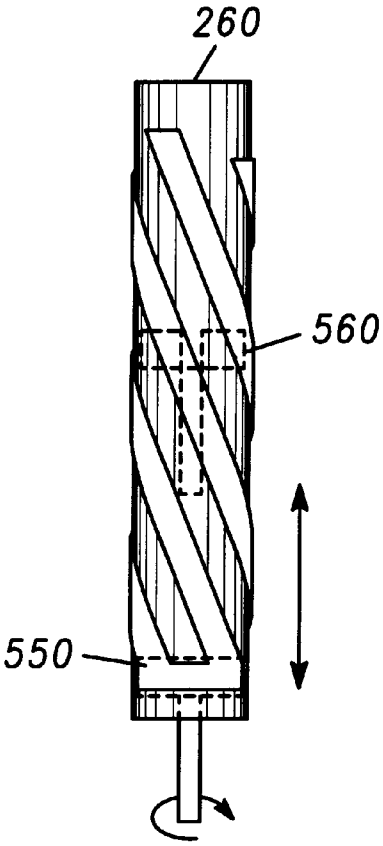
FIGS. 5 and 8, respectively, illustrate wound and unwound views of a sub-assembly of the antenna assembly according to a second alternative arrangement.

FIG. 5 illustrates an elongated dielectric tube 260 having capacitive plates at an extended position 550 at a lower portion and a retracted position 560 at an upper portion where the plates rotate when slid according to a second approach.

Figure 6:
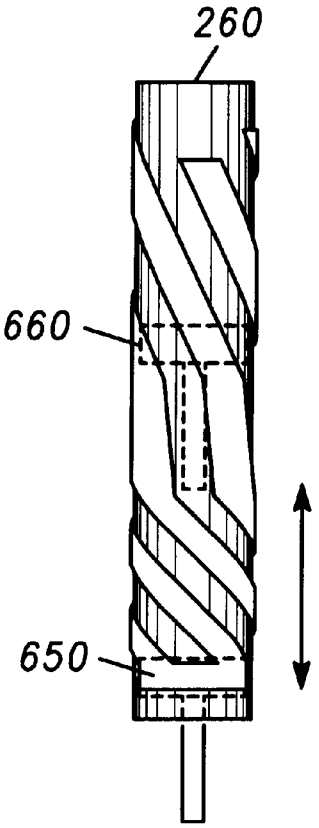
FIGS. 6 and 9, respectively, illustrate wound and unwound views of a sub-assembly of the antenna assembly according to a third alternative arrangement.

FIG. 6 illustrates the elongated dielectric tube 260 with the capacitive plates at an extended position 650 at a lower portion and a retracted position 660 at an upper portion where the capacitive plates do not rotate when slid, but the arms twist at a non-constant rate for configuration with the capacitive plates at the retracted position 660 according to a third approach.

Figure 9:
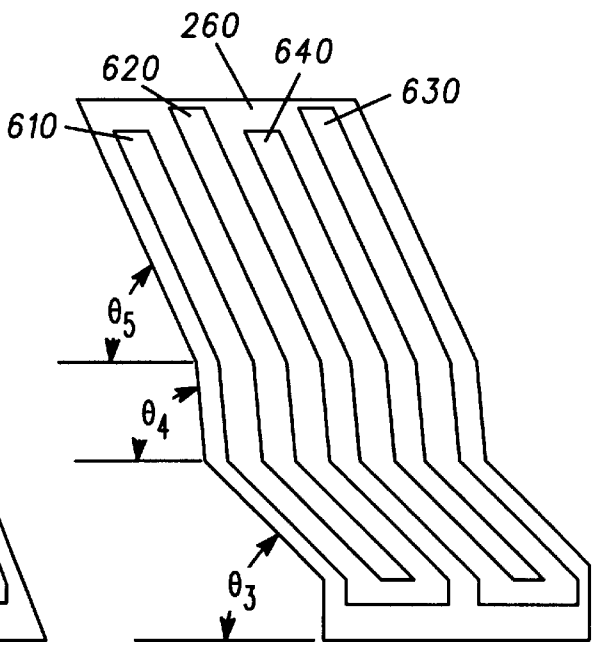
Figure 8:
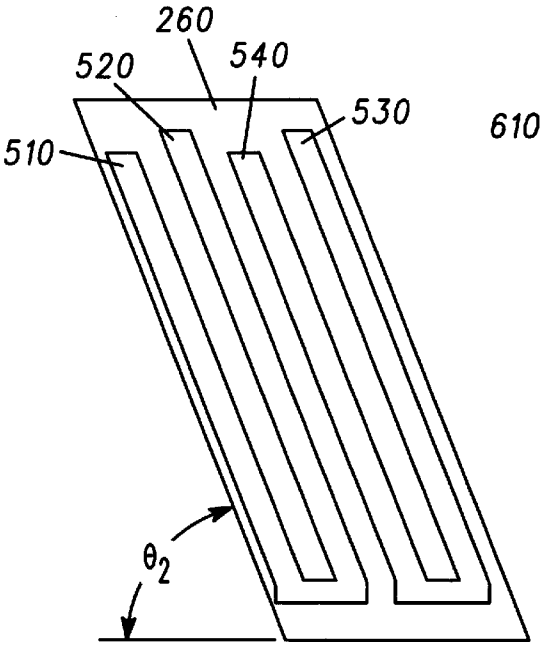
Figure 7:
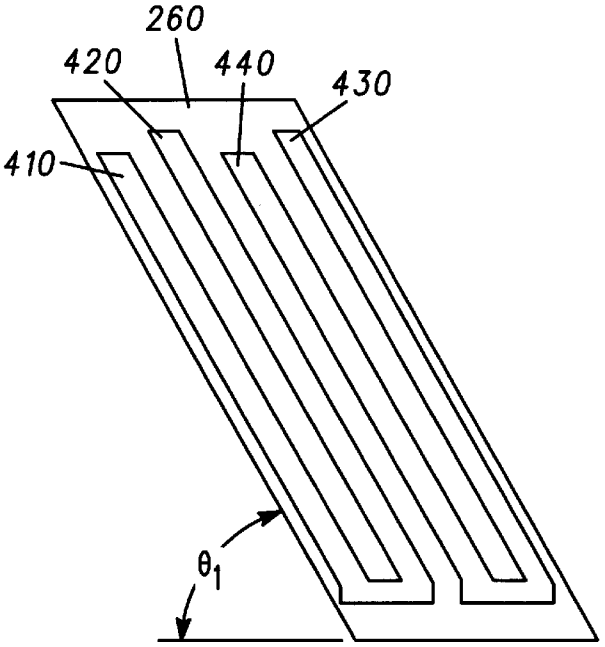

FIGS. 7, 8 and 9 respectively illustrate an unwrapped outer surface of the elongated dielectric tube and arms according to respective first, second and third approaches of FIGS. 4–6 respectively. According to the first approach, in FIG. 7, the arms 410, 420, 430 and 440 twist at a uniform angle $\theta 1$ along a length of the elongated dielectric tube 260. FIG. 8 illustrates arms 510, 520, 530 and 540 on an outer surface of the elongated dielectric tube 260 having a constant angle $\theta 2$. The angle $\theta 1$ is tilted more than the angle $\theta 2$.

Less tilt on the arms than in the first approach is desired for satellite communications to enhance pattern characteristics at lower elevation angles. Less tilt is utilized by this second approach because the capacitive plates rotate when slid. The preferred angle for θ1 is approximately 60.93 degrees and the preferred angle for θ2 is approximately 67.8 degrees.

In FIG. 9, the arms 610, 620, 630 and 640 are bent arms having multiple segments between multiple elbows. The segments extend at the illustrated angles θ3, θ4, and θ5 with respect to the horizontal. Preferably, θ3 is approximately 45.00 degrees, θ4 is approximately 84.60 degrees, and θ5 is approximately 68.00 degrees. The arms are bent an amount at the elbows so that, at upper and lower positions of the stroke, the capacitive plates are adjacent to current maximums. The current maximums are approximately one-half wavelength apart along electrical lengths of the arms as discussed above. This bent arm arrangement in FIGS. 6 and 9 has been found to provide greater design flexibility for telescoping and radiation pattern shaping than the arrangement in FIGS. 4 and 7 by avoiding the more tilted constant angle θ1. In this third approach, the number of elbows can approach infinity and thus the angles change progressively along an arm.

Figure 10:
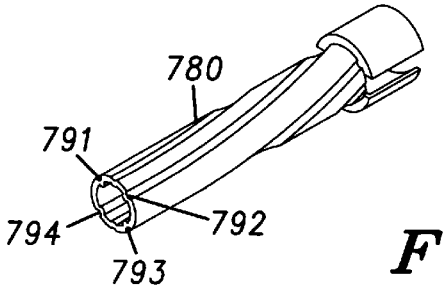
FIG. 10 illustrates an exemplary construction of a bearing to implement the second arrangement of FIGS. 5 and 8.

FIG. 10 illustrates an exemplary construction of an inner bearing to implement the second approach of FIGS. 5 and 8. Axially moving an inner bearing 780 relative to an outer bearing causes the capacitive plates to rotate because grooves 791, 792, 793, 794 are non-straight or twisted grooves. Mechanical constructions for rotating the capacitive plates have been found more mechanically difficult and expensive than stationary non-rotating approaches. Under certain electrical constraints, however, the rotating approaches provide more design flexibility. Although twisted grooves on an inner bearing are illustrated by example, other mechanical constructions are possible.

Although the invention has been described and illustrated in the above description and drawings, it is understood that this description is by example only and that numerous changes and modifications can be made by those skilled in the art without departing from the true spirit and scope of the invention. The present invention is applicable to analog as well as digital voice, data or paging satellite systems. The present invention is also applicable to terrestrial antennas for portable radios requiring small antennas and uniform patterns. While the present invention has size advantages for a portable radio, the present invention also has advantages for fixed and mobile radios.

What is claimed is:

1. A telescoping antenna assembly, comprising a circularly polarized antenna element having a plurality of arms, the circularly polarized antenna element disposed to telescope by sliding with respect to a group of exciters, wherein a physical position of said circularly polarized antenna element changes when slid with respect to the group of exciters, wherein the group of exciters has at least upper and lower operating positions located at an integral multiple of approximately one-half a wavelength apart along an electrical length of the circularly polarized antenna element; and a slidably-disposed bearing to guide movement of the plurality of arms and the group of exciters relative to one another.

2. A telescopic antenna assembly according to claim 1, wherein at least one of the upper and lower operating positions is at an electrical end of the circularly polarized antenna element.

3. A telescopic antenna assembly according to claim 2, wherein the other of the upper and lower positions is at an opposite electrical end of the circularly polarized antenna element.

4. A telescopic antenna assembly according to claim 1, wherein the group of exciters is slidably-disposed on an interior of the circularly polarized antenna element.

5. A telescopic antenna assembly according to claim 1, wherein the plurality of arms comprise bent arms.

6. A telescopic antenna assembly according to claim 5, wherein the bent arms comprise at least two elbows between respective segments.

7. A telescopic antenna assembly according to claim 1, wherein the slidably-disposed bearing has straight grooves to prevent rotational movement when slid.

8. A telescopic antenna assembly according to claim 1, wherein the slidably-disposed bearing has non-straight grooves to cause rotational movement when slid.

9. A telescopic antenna assembly according to claim 1, wherein the circularly polarized antenna element comprises a quadrifilar helix antenna assembly.

10. A telescopic antenna assembly according to claim 1, wherein group of exciters comprises capacitive plates for slidable capacitive coupling with the circularly polarized antenna element.

11. A telescopic antenna assembly, comprising:

an antenna element comprising at least one pair of arms formed of an electrically conductive material;

a first lower portion of a first arm of the at least one pair of arms;

a second lower portion of a second arm of the at least one pair of arms;

a first upper portion of the first arm of the at least one pair of arms;

a second upper portion of the second arm of the at least one pair of arms;

a hot conductor slidably-disposed adjacent to the antenna element for selective electromagnetic coupling with the first lower portion and the first upper portion;

a ground conductor slidably-disposed adjacent to the antenna element for selective electromagnetic coupling with the second lower portion and the second upper portion;

a feedpoint having a hot lead and a ground lead operatively coupled to respective of the hot conductor and the ground conductor; and a slidably-disposed bearing to guide movement of the arms and the hot and ground conductors relative to one another.

12. A telescopic antenna assembly according to claim 11, wherein the upper and lower portions are integral multiples of approximately one-half a wavelength apart along an electrical length of the arms.

13. A telescopic antenna assembly according to claim 11, wherein the first upper portion is spaced an electrical distance along the arm an integral multiple of approximately one-half a wavelength from the first lower portion; and wherein the second upper portion is spaced an electrical distance along the arm an integral multiple of approximately one-half a wavelength from the second lower portion.

14. A telescopic antenna assembly according to claim 11, wherein at least one of both the first and second upper portions or of both the first and second lower portions is at an electrical end of the arms.

15. A telescopic antenna assembly according to claim 14, wherein the other at least one of both the first and second upper portions or of both the first and second lower portions is at an opposite electrical end of the arms.

16. A telescopic antenna assembly according to claim 11, wherein the hot and ground conductors are slidably-disposed on an interior of the antenna element.

17. A telescopic antenna assembly according to claim 11, wherein the at least one pair of arms comprise bent arms.

18. A telescopic antenna assembly according to claim 17, wherein the bent arms comprise at least two elbows between respective segments.

19. A telescopic antenna assembly according to claim 11, wherein the arms are formed of strips of an electrically conductive material conforming to a shape of the surface of the elongated dielectric tube.

20. A telescopic antenna assembly according to claim 11, wherein the hot and ground conductors are formed of an electrically conductive material having a surface shape conforming to a shape of a surface of the elongated dielectric tube.

21. A telescopic antenna assembly according to claim 11, wherein the slidably-disposed bearing has straight grooves to prevent rotational movement when slid.

22. A telescopic antenna assembly according to claim 11, wherein the slidably-disposed bearing has non-straight grooves to cause rotational movement when slid.

23. A telescopic antenna assembly according to claim 11, wherein the slidably-disposed bearing comprises a dielectric surface having a shape mating with a shape of the elongated dielectric tube.

24. A telescopic antenna assembly according to claim 11, wherein two of the at least one pair of arms form two loops providing a crossed loop antenna assembly.

25. A telescopic antenna assembly according to claim 11, wherein two of the at least one pair of arms form two twisted and crossed loops providing a quadrifilar helix antenna assembly.

26. A telescopic antenna assembly according to claim 11, wherein the antenna assembly forms a circularly polarized antenna assembly.

27. A telescopic antenna assembly according to claim 11, wherein the feedpoint comprises an unbalanced feedline operatively coupled to a balun.

28. A telescopic antenna assembly according to claim 27, wherein the feedline is coaxial and the ground lead is an outer conductor of the feedline; and wherein the balun comprises a split in the ground conductor of the feedline to form a split sheath balun structure, wherein sides of the split are directly connected to one of the hot and ground conductors.

29. A telescopic antenna assembly according to claim 11, wherein the hot and ground conductors each respectively comprise capacitive plates for capacitive coupling with the arms.

30. A telescoping antenna assembly, comprising a circularly polarized antenna element having a plurality of arms, the circularly polarized antenna element disposed to telescope by sliding with respect to a group of exciters, wherein a physical position of said circularly polarized antenna element changes when slid with respect to the group of exciters, wherein the group of exciters has at least upper and lower operating positions wherein at least one of the upper and lower operating positions is above a lower end of the circularly polarized antenna element and the other one of the upper and lower operating positions is below an upper end of the circularly polarized antenna element; and a slidably-disposed bearing to guide movement of the plurality of arms and the group of exciters relative to one another.

31. A telescopic antenna assembly, comprising:

an elongated dielectric tube having a surface;

an antenna element comprising at least one pair of arms formed of electrically conductive material associated with a shape of the surface of the elongated dielectric tube;

a first lower portion of a first arm of the at least one pair of arms formed of the same electrically conductive material as the antenna element;

a second lower portion of a second arm of the at least one pair of arms formed of the same electrically conductive material as the antenna element;

a first upper portion of a first arm of the at least one pair of arms formed of the same electrically conductive material as the antenna element;

a second upper portion of a second arm of the at least one pair of arms formed of the same electrically conductive material as the antenna element;

a hot capacitive plate slidably-disposed on an interior of the dielectric tube for selective capacitive coupling with either one of the first lower portion and the first upper portion and formed of an electrically conductive material having a shape conforming to a shape of the surface of the elongated dielectric tube;

a ground capacitive plate slidably-disposed on the interior of the dielectric tube for selective capacitive coupling with either one of the second lower portion and the second upper portion and formed of an electrically conductive material having a shape conforming to a shape of the surface of the elongated dielectric tube;

a feedline having a hot lead and a ground lead operatively coupled to respective of the hot capacitive plate and the ground capacitive plate; and a slidably-disposed bearing to guide movement of the at least one pair of arms and the hot and ground capacitive plates relative to one another.

* * * * *